United States Patent [19]

Schweinberger

[11] Patent Number: 4,767,101

[45] Date of Patent: Aug. 30, 1988

[54] CABLE PULLEY

[75] Inventor: Anton Schweinberger, Aschau, Austria

[73] Assignee: Innoma Innovation-Marketing Patentverwertungs Ges.m.b.H., Seefeld, Austria

[21] Appl. No.: 928,223

[22] PCT Filed: Feb. 21, 1986

[86] PCT No.: PCT/AT86/00015

§ 371 Date: Oct. 27, 1986

§ 102(e) Date: Oct. 27, 1986

[87] PCT Pub. No.: WO86/04885

PCT Pub. Date: Aug. 28, 1986

[30] Foreign Application Priority Data

Feb. 26, 1985 [AT] Austria ..... A567/85

[51] Int. Cl.[4] ..... A62B 1/08; B66D 3/04

[52] U.S. Cl. ..... 254/391; 182/43; 182/73; 254/411

[58] Field of Search ..... 254/390, 391, 403, 405, 254/408, 409, 410, 411, 413, 415; 242/86.1, 86.5 A, 100.1; 182/73, 42, 43

[56] References Cited

U.S. PATENT DOCUMENTS

| | | | |
|---|---|---|---|
| 291,326 | 1/1884 | French | 182/73 X |
| 692,847 | 2/1902 | Goodfellow | 182/73 |
| 996,803 | 7/1911 | Schnoor | 254/390 X |
| 1,350,708 | 8/1920 | Davis . | |
| 1,451,557 | 4/1923 | Toth et al. | 254/391 |
| 2,806,380 | 9/1957 | Martin | 254/390 |
| 2,872,047 | 2/1959 | Ostlund | 242/100.1 X |
| 3,062,477 | 11/1962 | Horning | 242/100.1 |
| 3,860,092 | 1/1975 | Holmes . | |
| 4,492,363 | 1/1985 | Niskin | 254/411 X |

FOREIGN PATENT DOCUMENTS

| | | | |
|---|---|---|---|
| 676960 | 12/1963 | Canada | 254/391 |
| 61618 | 4/1891 | Fed. Rep. of Germany . | |
| 124528 | 7/1900 | Fed. Rep. of Germany . | |
| 330809 | 4/1903 | France . | |
| 388684 | 6/1907 | France . | |
| 489453 | 3/1918 | France . | |
| 1388950 | 12/1963 | France . | |
| 194368 | 2/1965 | Sweden | 254/390 |
| 15346 | of 1914 | United Kingdom . | |

*Primary Examiner*—Stuart S. Levy
*Assistant Examiner*—Joseph J. Hail, III
*Attorney, Agent, or Firm*—Wenderoth, Lind & Ponack

[57] ABSTRACT

A cable pulley arrangement including a pulley on which a cable is wound. The pulley is held by a lock device. When the lock device is released, the cable is unwound by a weight is hung on the ends thereof. The cable is so arranged that, when the cable is wound on the pulley, both ends of the cable are at one side of the pulley, while when the cable is unwound the ends hang down at both sides of the pulley.

11 Claims, 2 Drawing Sheets

CABLE PULLEY

BACKGROUND OF THE INVENTION

The invention relates to a cable pulley arrangement comprising a pulley which is freely rotatable on a suspension device, and a cable which passes over the pulley and which in the unwound condition hangs down on both sides of the pulley.

It is known that, for example when considering fires in multi-storey buildings, one of the difficult problems which hitherto has been only partially solved is that of rescuing people who are on the upper storeys, that is to say, removing them from the area of danger. It is only in the rarest cases that the ladders available to a fire brigade can reach the tenth storey. With regard to higher storeys, rescue is only possible from the air, for example by means of a helicopter. In that situation, apart from the high costs involved, the problem which occurs is that it is not possible for a number of helicopters to operate in a rather small air space, for safety reasons. Consequently, only a very limited number of people can be removed from the building by the helicopter and the evacuation of the people concerned takes up a very great deal of time, and in many cases, the amount of time involved is not adequate.

SUMMARY OF THE INVENTION

The object of the present invention is therefore to provide a cable pulley arrangement of the kind set forth above and which can be used in particular for rescuing people from multi-storey buildings or skyscrapers. A cable pulley arrangement of that kind is preferably fixed to the edge of the roof adjacent the facade or front of the building.

This object according to the invention is solved in that a lock means which is remotely releasable, for example by means of a release line, and which blocks the pulley, is provided on a suspension device, of the cable pulley arrangement wherein the blocked condition of the pulley the cable is wound thereon, more specifically in such a way that, of the unwound cable whose two end runs hang down over approximately equal lengths on both sides of the pulley, an end run or portion is taken in a loop to the other end run or portion and the two end runs are wound on in the same direction, and that a weight hangs on both ends of the cable.

The cable pulley arrangement according to the invention permits the release line to be actuated from below, that is to say, from the ground floor of the building, whereupon the lock means is released, and the cable is pulled to the ground by the weight which is hung thereon, and is unrolled from the pulley. Using a cable which is relatively thin, for example a nylon cable, so that it can be wound on the pulley, it is then possible for a stronger cable which is capable of carrying a load to be pulled over the pulley. When that stronger cable is secured at one end to a winch or even a vehicle, for example a lorry, then for example a basket or a cabin can be pulled up the outside wall of the building to the top storey thereof.

With such a cabin, it would be easy to evacuate people in danger, from the individual storeys of the building, without putting them at risk.

Even if, with regard to the use of the cable pulley arrangement according to the invention, consideration is given more particularly to rescue functions, it is not restricted thereto. For example the cable pulley arrangement according to the invention may be used in the above-described manner in order to carry out maintenance operations on the facade of a building. The use of the cable pulley arrangement is also not restricted to buildings. Thus the cable pulley arrangement according to the invention could also be used in relation to cable car installations, once again for carrying out maintenance operations, or also for possibly bringing passengers down from stranded cable cars or the like, by a roping-down operation.

In order to facilitate the step of winding on the cable, it is advantageously provided in accordance with the invention that a magnet is disposed at the periphery of the pulley and an iron plumb weight or the like is disposed on the cable.

An embodiment of the invention has a radially downwardly projecting loop member which projects between the end runs and through which the end run which is taken to the other end run is pulled when the cable is wound on the pulley. When unwinding the cable, the loop member guarantees correct orientation thereof and prevents the cable from possibly becoming entangled.

Advantageously, there is provided a cover cap which surrounds the upper half of the pulley, the lateral spacing between the cover cap and the pulley being less than the diameter of the cable. The cover cap not only provides protection for the cable and the pulley from the influences of weather, but, by virtue of the fact that it embraces the pulley in very close relationship thereto, it also prevents the cable from jumping out of the guide groove of the pulley.

An embodiment of the invention provides that the lock means includes a hook which engages in a hole in the pulley.

It is advantageously provided that the lock means and the release line are separated from the cable pulley arrangement when the lock means is released. Complete separation of the lock member from the cable pulley arrangement gives two advantages. On the one hand, such separation ensures 100% that the lock means does not unintentionally re-engage, for example during a rescue operation, and possibly render the cable pulley arrangement inoperative. The second advantage is that, if for example the cable pulley arrangement is guided on a rail which extends over the width of the facade, the cable pulley arrangement can be pulled along the rail with the cable from below so that it can reach any point on the facade.

Another advantageous embodiment provides a protective cladding which covers the lower half of the pulley, to protect it from UVradiation. Such protective cladding is made for example from plastics materials and is intended to ensure that the cable which generally is in fact left on the pulley over a very long period of time does not become defective, before the moment of use thereof.

The protective cladding can advantageously be released from the cable pulley arrangement when the lock means is unlocked.

It is advantageously further provided that the two ends of the cable are connected to the same weight. That ensures that the two ends of the cable are loaded in an absolute equal fashion, while also ensuring that they cannot swing around.

BRIEF DESCRIPTION OF THE DRAWINGS

An embodiment of the invention is described in greater detail hereinafter with reference to the accompanying drawings, without the invention being restricted thereto, and wherein.

DETAILED DESCRIPTION OF THE INVENTION

Figure 1:
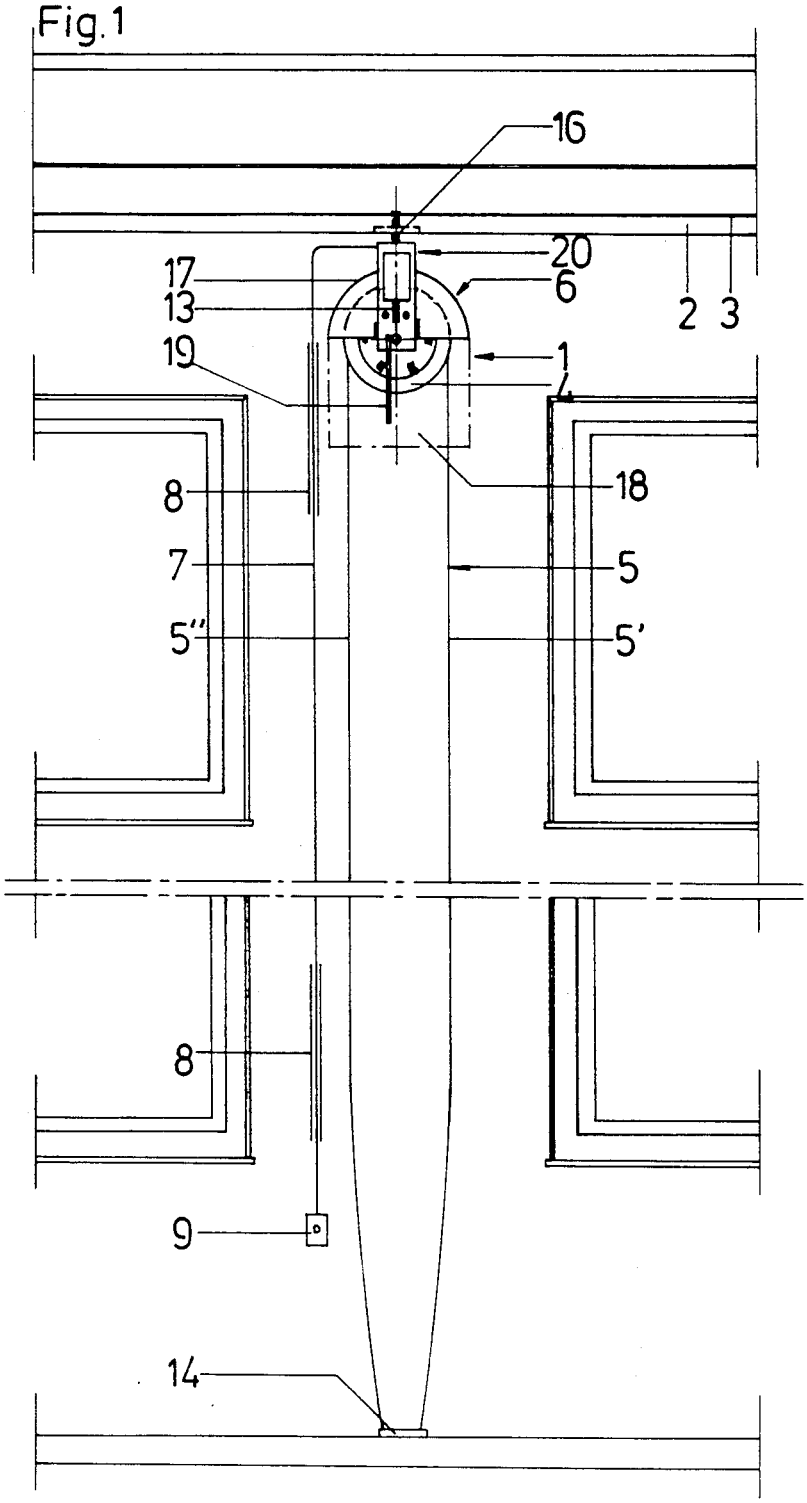
FIG. 1 is a diagrammatic side view of a cable pulley arrangement according to the invention, more particularly fixed to a facade of a building.

As can be seen from FIG. 1, a cable pulley arrangement 1 according to the invention is mounted movably on a rail 2. The rail 2 is disposed just beneath a roof edge portion 3, at the facade or front side of a building, preferably at a small spacing from the facade of the building.

The cable pulley arrangement 1 comprises a pulley 4 which is mounted on a suspension device 20, and over which a cable 5 is passed.

FIG. 1 shows the cable 5 in the position of use, that is to say, unwound. The cable 5 is normally wound on to the pulley 4 so that the front of the building is free.

Provided on the cable pulley arrangement 1 is a lock means 6 which prevents the pulley 4 from rotating.

The lock means 6 can be released from an unlocking location 9 for example by way of a release line 7 which is guided along the outside wall of the building, being protected in a tubular casing 8.

Figure 2:
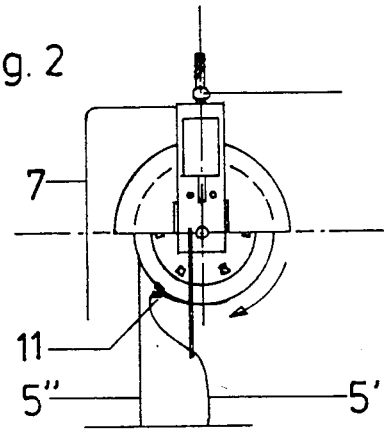
FIG. 2 is a side view of the cable pulley arrangement when beginning the operation of winding on a cable.

As can be seen from FIG. 2, the cable 5 is wound up by one end run or portion 5′ being taken to a second end run or portion 5″, with the two end runs then being wound onto the pulley 4 in the same direction, as indicated by the arrow.

In order to facilitate the operation of winding the cable onto the pulley, a magnet 10 is advantageously provided on the pulley 4, and an iron plumb weight 11 is provided on the cable 5. Thus, the iron plumb weight 11 which is on the end run 5′ only has to be pressed against the magnet 10 of the pulley 4, and that ensures that the cable 5 is securely wound on to the pulley, thus providing a releasable connection of end run 5′ to the periphery of pulley 4.

Figure 3:
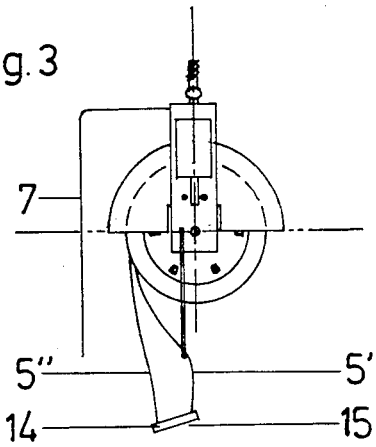
FIG. 3 is a side view of the cable pulley arrangement with the cable wound thereon.

When the cable 5 has been wound on to the pulley, the situation is that shown in FIG. 3, that is to say, both ends 15 of the cable or both cable runs 5′ and 5″ hand down at one side of the pulley 4.

Figure 4:
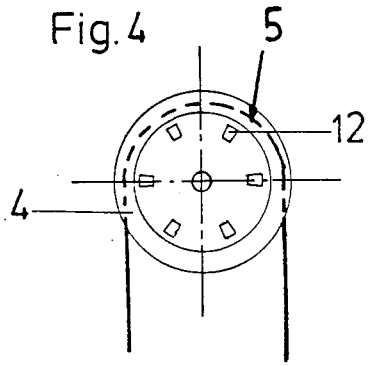
FIG. 4 is a view in the axial direction of the pulley with the cable passing therearound.
Figure 5:
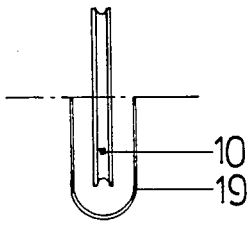
FIG. 5 is a view of the pulley in the radial direction.

As can be seen from FIG. 4, the pulley 4 is provided with holes 12 in which a hook 13 of the lock means 6 engages. That ensures that the pulley 4 is locked positively and in an absolutely secure fashion.

When, as stated, the lock means 6 is released by way of the release line 7, the pulley 4 is free and the end runs 5′ and 5″ of the cable are pulled down by a weight 14.

When, in relation to the illustrated embodiment, reference is made to purely mechanical release of the lock means 6 by the pull line 7, it is to be understood in that respect that the release action could also be produced electrically, for example by way of an electromagnetic switch.

When the lock means 6, with the release line 7, is completely separated from the cable pulley arrangement 1 during a release operation, then the cable pulley arrangement 1 can be pulled over the length of the rail 2, by means of the cable 5.

The cable pulley arrangement 1 is advantageously provided with a pivot means 16 so that it can take up different angular positions or so that a stronger cable which is pulled over the pulley 4 by the cable 5 can extend at an inclined angle relative to the facade of the building.

In order to prevent the cable 5 from becoming entangled, a loop member 19 is provided which extends around the lower part of the pulley 4. Also, a cover cap 17 surrounds the upper half of pulley 4, and the lateral spacing between each side of pulley 4 and the respective side of cover cap 17 is less than the diameter of cable 5.

FIG. 1 also shows the protective cladding 18 for providing protection against UV-radiation, as indicated by dash-dotted lines.

What is claimed is:

1. A cable pulley arrangement comprising:
   - a pulley freely rotatably mounted on a suspension device;
   - a cable passing over the periphery of said pulley and having opposite runs of substantially equal length extending from opposite sides of said pulley, said cable runs having weighted ends;
   - means for releasably connecting one of said runs to said periphery of said pulley such that rotation of said pulley results in both of said runs being wound in the same direction on said pulley;
   - lock means including a member which engages in a hole or recess in said pulley for preventing rotation of said pulley; and
   - lock release means, operable from a location remote from said pulley, for releasing said lock means such that said pulley is rotatable and thereby for allowing said weighted ends of said cable to unwind said cable from said pulley.

2. A cable pulley arrangement as claimed in claim 1, wherein said connecting means comprises a magnet disposed at said periphery of said pulley and an iron member disposed on said cable.

3. A cable pulley arrangement as claimed in claim 1, further comprising a loop member radially downwardly projecting from said pulley at a position between said runs and through which said one run is moved to the other run when said cable is wound on said pulley.

4. A cable pulley arrangement as claimed in claim 1, further comprising a cover cap surrounding the upper half of said pulley, a later spacing between said cover cap and said pulley being less than the diameter of said cable.

5. A cable pulley arrangement as claimed in claim 1, wherein said member comprises a hook.

6. A cable pulley arrangement as claimed in claim 1, wherein said suspension device includes a pivot mounting.

7. A cable pulley arrangement as claimed in claim 1, wherein said lock means and said lock release means are separated from said cable pulley arrangement when said lock means is released.

8. A cable pulley arrangement as claimed in claim 1, further comprising a protective cladding against UV-radiation covering the lower half of said pulley.

9. A cable pulley arrangement as claimed in claim 8, wherein said protective cladding is released from said cable pulley arrangement upon operation of said lock release means for releasing said lock means.

10. A cable pulley arrangement as claimed in claim 1, wherein said suspension device is guided on a rail.

11. A cable pulley arrangement as claimed in claim 1, wherein said ends of both said runs of said cable are connected to the same weight.

* * * * *